United States Patent [19]

Rissel

[11] Patent Number: 4,878,324

[45] Date of Patent: Nov. 7, 1989

[54] BUILDING BLOCKS FOR BUILDING SHIELDING WALLS AGAINST RADIOACTIVE RADIATION

[75] Inventor: Heinz Rissel, Erlensee, Fed. Rep. of Germany

[73] Assignee: Rheinhold & Mahla GmbH, Fed. Rep. of Germany

[21] Appl. No.: 178,460

[22] Filed: Apr. 7, 1988

[30] Foreign Application Priority Data

Aug. 19, 1987 [DE] Fed. Rep. of Germany ..... 3727685

[51] Int. Cl.[4] ..... E04C 1/10

[52] U.S. Cl. ..... 52/125.2; 52/593; 52/598; 110/340

[58] Field of Search ..... 52/593, 589, 598, 125.2, 52/125.3, DIG. 9, 596, 724; 206/509, 504; 110/340

[56] References Cited

U.S. PATENT DOCUMENTS

| | | | |
|---|---|---|---|
| 689,523 | 12/1901 | Trumbull | 52/593 X |
| 1,753,776 | 4/1930 | DeVibiss | 52/DIG. 9 X |
| 2,670,698 | 3/1954 | Poth | 110/340 X |
| 3,073,067 | 1/1963 | Shonkwiler | 110/340 X |
| 3,181,486 | 5/1965 | King | 110/340 |
| 3,187,694 | 6/1965 | Crookston et al. | 110/340 |
| 3,259,086 | 7/1966 | Stein | 110/340 |
| 3,315,430 | 4/1967 | Reynolds et al. | 52/125.3 X |
| 3,324,811 | 6/1967 | Lloyd | 110/340 |
| 3,390,505 | 7/1968 | Dockerty | 52/596 |
| 3,487,603 | 1/1970 | Roberts, Jr. | 52/596 X |
| 3,566,571 | 3/1971 | Stein | 52/598 |
| 3,913,292 | 10/1975 | Braekkan | 52/593 X |
| 4,107,894 | 8/1978 | Mullins | 52/593 |
| 4,170,856 | 10/1979 | Musser | 110/340 X |
| 4,427,818 | 1/1984 | Prusinski | 52/DIG. 9 X |

FOREIGN PATENT DOCUMENTS

| | | | |
|---|---|---|---|
| 660896 | 10/1965 | Belgium | 206/509 |
| 634487 | 1/1962 | Canada | 110/340 |
| 3233470 | 3/1984 | Fed. Rep. of Germany | 52/596 |
| 1100099 | 9/1955 | France | 206/504 |
| 1273685 | 9/1961 | France | 110/340 |

*Primary Examiner*—David A. Scherbel
*Assistant Examiner*—Lan Mai
*Attorney, Agent, or Firm*—Steele, Gould & Fried

[57] ABSTRACT

The present invention pertains to building blocks, especially for erecting shielding walls in nuclear facilities. Each building block is made of a cubeshaped metal jacket consisting of steel plate, especially special steel, which jacket is closed on all sides and is filled with concrete. To facilitate the handling and to permit the erection of shielding walls with building blocks in fixed positions, the top surfaces and the bottom surfaces (2, 4) of the jacket (1) are provided with bulging formations in the form of projections (3) and depressions (4) [sic, (5)] which engage with each other between adjacent building blocks to mutually fix the positions of the building blocks.

7 Claims, 1 Drawing Sheet

BUILDING BLOCKS FOR BUILDING SHIELDING WALLS AGAINST RADIOACTIVE RADIATION

The present invention pertains to building blocks used to "erect" temporary shielding walls in nuclear facilities.

FIELD OF THE INVENTION

If work must be performed in the vicinity of components with high radioactive radiation levels in nuclear facilities, temporary walls must be erected as radiation protection walls to reduce the radiation level at the job site. These walls consist, in general, of radiation-absorbing building blocks which are cube-shaped with an edge length of ca. 20 cm. Prior-art building blocks used for this purpose are massive lead blocks and are embedded in a special concrete.

Even though building blocks made from lead have good radiation absorption, they are difficult to handle because of their high weight, and it is especially impossible to provide handles which would facilitate handling because the metal is too soft to permanently receive bolts or other holding means.

The basic task of the present invention is therefore to create a building block which has almost the same degree of radiation absorption as the prior-art building blocks made from lead, but can be handled much more easily and can be stacked up in a simple manner according to their contours.

SUMMARY OF THE INVENTION

To accomplish this task according to the present invention, the jacket consists of steel plate whose top and bottom surfaces are provided with bulging formations in the form of projections and depressions reaching into one another between adjacent stones for mutual fixation of the positions of the building blocks.

Such a jacket made from steel plate, especially special steel plate, is highly stable, on the one hand, and can be worked and shaped as desired, without any detriment to strength, on the other hand. The disadvantages of the relatively smooth surface of such a special steel plate with low coefficients of friction, which increases the risk of slipping of the stacked-up building blocks, is eliminated by providing bulging formations reaching into one another in one direction or the other in the top and bottom surfaces of the cube-shaped steel jackets.

These bulging formations are preferably truncated cone- or cup-shaped, so that they can be prepared in a simple pressing process. It is also possible to replace building formations arranged in a punctiform pattern by groove-shaped recesses which mesh with matching webs on the superjacent or subjacent building blocks.

In the case of bulging formations arranged in a punctiform pattern, at least two such bulging formations should be provided on each locking surface (top surface or bottom surface) to prevent not only lateral displacement, but also twisting of the building blocks relative to each other.

In addition, swing-out sunk-in handles are provided on two mutually opposite lateral surfaces such that the handles are perfectly flush with the outer contour of the jacket in the swung-in position. Easy handling of the individual building blocks is thus guaranteed without dense packing of adjacent building blocks being hindered.

To attach these handles, the lateral surfaces can have approximately rectangular openings into which plates of the same material carrying recesses following the outer contour of the swing-out handle are welded on the inside.

BRIEF DESCRIPTION OF THE DRAWINGS

The structure and the function of an embodiment of the present invention will be explained on the basis of a schematic drawing. Here.

DETAILED DESCRIPTION OF THE PREFERRED EMBODIMENTS

Figure 1:
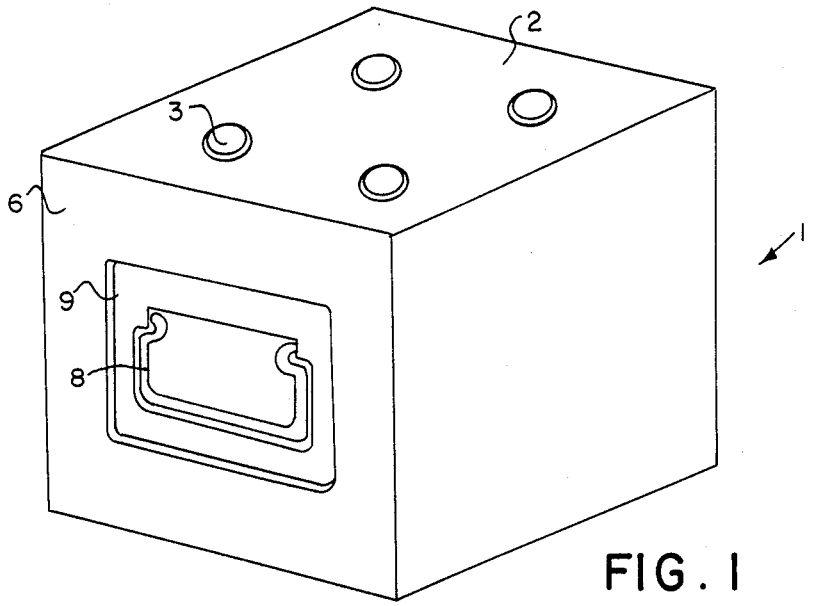
FIG. 1 shows a perspective view of a finished building block.
Figure 2:
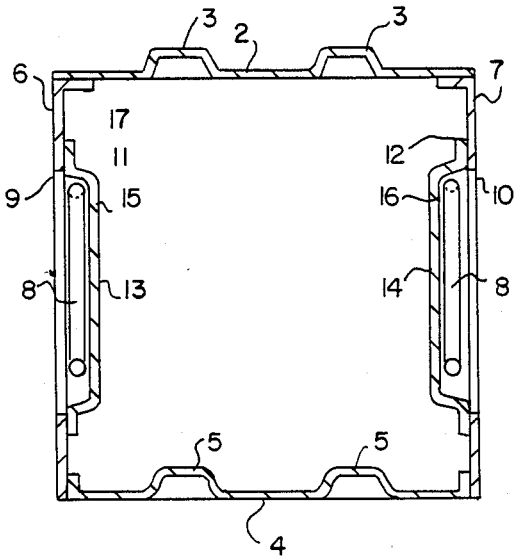
FIG. 2 shows a cross section of a building block according to line II—II in FIG. 1.

As is apparent from FIGS. 1 and 2, the building block 1 has a cube-shaped outer contour which is made from a plate jacket consisting of V2A steel. In the embodiment shown, the top surface 2 is provided with four bulging formations directed to the outside in the form of projections 3, which are approximately truncated cone-shaped. In contrast, the bottom surface 4 of the cube 1 has bulging formations reaching into the inside in the form of depressions 5, whose geometric pattern is the same as that of the projections 3 in the top surface 2.

Thus, when building blocks 1 of such a shape are stacked up one upon another, the projections 3 of the top surfaces 2 always engage with the depressions 5 in the bottom surface 4 of the superjacent building block, so that the correct positions of the individual building blocks relative to each other are ensured, and a mutual displacement is especially prevented.

To facilitate handling, the building blocks 1 have sunk-in swing-out handles 8 provided on two mutually opposite lateral surfaces 6 and 7, which do not jut out of the cube-shaped outer contour of the building block 1 and can be disposed as follows.

The lateral surfaces 6 and 7 have an approximately rectangular opening 9 and 10, respectively, which is slightly larger than the outer contour of the handles 8. A plate 11 and 12, made from the same material as the jacket of the building block 1, is welded against these openings 9 and 10, respectively, so that these plates 11 and 12 have a recess 13 and 14, respectively, following the outer contour of the swing-out handle 8. The handles 8 are then placed into corresponding cutouts 15 and 16 in thE upper zone of the wall parts of the recesses 13 and 14, which said parts reach obliquely into the inside, and thus they are held secured against rotation.

When such a building block is prepared, the lateral surfaces defining the cube contour are first connected to each other by means of the handles 8 already welded in, after which the bottom surface 4 already provided with the depressions 5 is welded in. The cube, which is now open at the top, is then filled with a special concrete and cured. The top surface 2 with the projections 3 already formed is finally welded onto the fold 17 bent inward.

A building block that is tightly closed on all sides is thus obtained, which is easy to handle and transport, on the one hand, and which cannot become displaced during the erection of the wall because of the meshing building formations, on the other hand.

To also guarantee mutual fixation of the building stones in the horizontal direction especially in the case of especially tall walls, corresponding bulging formations can also be provided on the side walls which are mutually in contact with each other, e.g., also around the handles.

I claim:

1. Building stone, for use in constructing temporary walls for shielding against nuclear radiation, in a form of a compact cube, comprising:

a cube formed by steel plates and filled with concrete, the cube having a top surface and a bottom surface (2,4) provided with bulging formations in a form of one of projections (3) and depressions (5) which engage with each other between adjacent building blocks, whereby mutual positions of the building blocks are fixed; and, swing-out handles (8) sunk in on two mutually opposite lateral surfaces (6,7) of said cube such that the lateral surfaces are flush with an outer contour of the cube in a swung-in position of said handles.

2. Building blocks in accordance with claim 1, wherein the bulging formations (3,5) are truncated cone-shaped formations.

3. Building blocks in accordance with claim 1, wherein at least two bulging formations (3,5) are provided on at least one of each top surface and bottom surface.

4. Building blocks in accordance with claim 1, wherein the lateral surfaces (6,7) have approximately rectangular openings (9,10) into which further steel plates (11,12) are welded from the inside of the cube, the further steel plates have recesses (13,14) following an outer contour of the swing-out handles (8).

5. Building blocks in accordance with claim 1, wherein the bulging formations (3,5) are truncated cup-shaped formations.

6. Building blocks in accordance with claim 2, wherein at least two bulging formations (3,5) are provided on at least one of each top surface and bottom surface.

7. Building blocks in accordance with claim 5, wherein at least two bulging formations (3,5) are provided on at least one of each top surface and bottom surface.

* * * * *